United States Patent [19]

Banks

[11] Patent Number: 4,738,540

[45] Date of Patent: Apr. 19, 1988

[54] MIXER BLENDER

[75] Inventor: James V. Banks, Brockton, Mass.

[73] Assignee: Control Fluidics, Inc., Greenwic, Conn.

[21] Appl. No.: 904,935

[22] Filed: Sep. 8, 1986

[51] Int. Cl.[4] ..... B01F 5/00; B01F 5/10; B01F 15/02

[52] U.S. Cl. ..... 366/137; 366/165; 366/176; 366/336; 366/341

[58] Field of Search ..... 366/15, 30, 76, 131, 366/136, 137, 165, 154, 167, 150, 176, 177, 178, 190, 336, 341, 604; 137/896, 897; 239/310, 318, 421

[56] References Cited

U.S. PATENT DOCUMENTS

| | | | |
|---|---|---|---|
| 2,997,373 | 8/1961 | Stephens | 366/137 X |
| 4,007,921 | 2/1977 | Zingg | 366/136 X |
| 4,077,612 | 3/1978 | Ricciardi | 366/102 |
| 4,100,614 | 7/1978 | Mandt | 366/154 |
| 4,162,128 | 7/1979 | Ogden et al. | 366/154 |
| 4,643,582 | 2/1987 | Ricciardi | 366/178 X |

*Primary Examiner*—Timothy F. Simone
*Attorney, Agent, or Firm*—Robert T. Gammons

[57] ABSTRACT

A blender wherein the fluids to be blended are compelled to flow through a bed of loosely-associated buoyant bodies.

7 Claims, 2 Drawing Sheets

MIXER BLENDER

BACKGROUND OF THE INVENTION

Conventionally, fluids are blended by introducing them into a vessel containing mechanical means such as rotating blades to cause mixing of the fluids. The fluids may be passed through the vessel one or more times, depending upon the degree of mixing desired and/or the composition of the fluids. It is the purpose of this invention to provide a blender for mixing fluids without the aid of mechanically driven blades or beaters.

SUMMARY OF THE INVENTION

A blender comprising means defining a chamber for receiving fluids to be blended, means for supplying the fluids to the blender to the top of the chamber and for withdrawing the blended fluids from the bottom and means within the chamber for blending the fluids while in transport from the top to the bottom comprising a secondary chamber within the primary chamber adjacent the top containing a bed of loosely-associated, buoyant bodies through which the fluids are compelled to flow as they are transported from the top to the bottom and a Venturi in the primary chamber arranged to deliver fluids supplied to the top of the primary chamber into the secondary chamber and simultaneously to induce fluids from the primary chamber into the secondary chamber for mingling with the fluid passing through the Venturi. The secondary chamber is in the form of an inverted cone and the discharge end of the Venturi is positioned at the apex thereof. The base of the cone is provided with a grating for retaining the buoyant bodies. In one form the blender is provided with a pump for withdrawing the fluids from the lower end and returning them to the top to effect transport of the fluids through the blender and to repeat the blending operation a sufficient number of times to effect complete blending. Optionally the fluids are transported through the blender only once.

Figure 1:
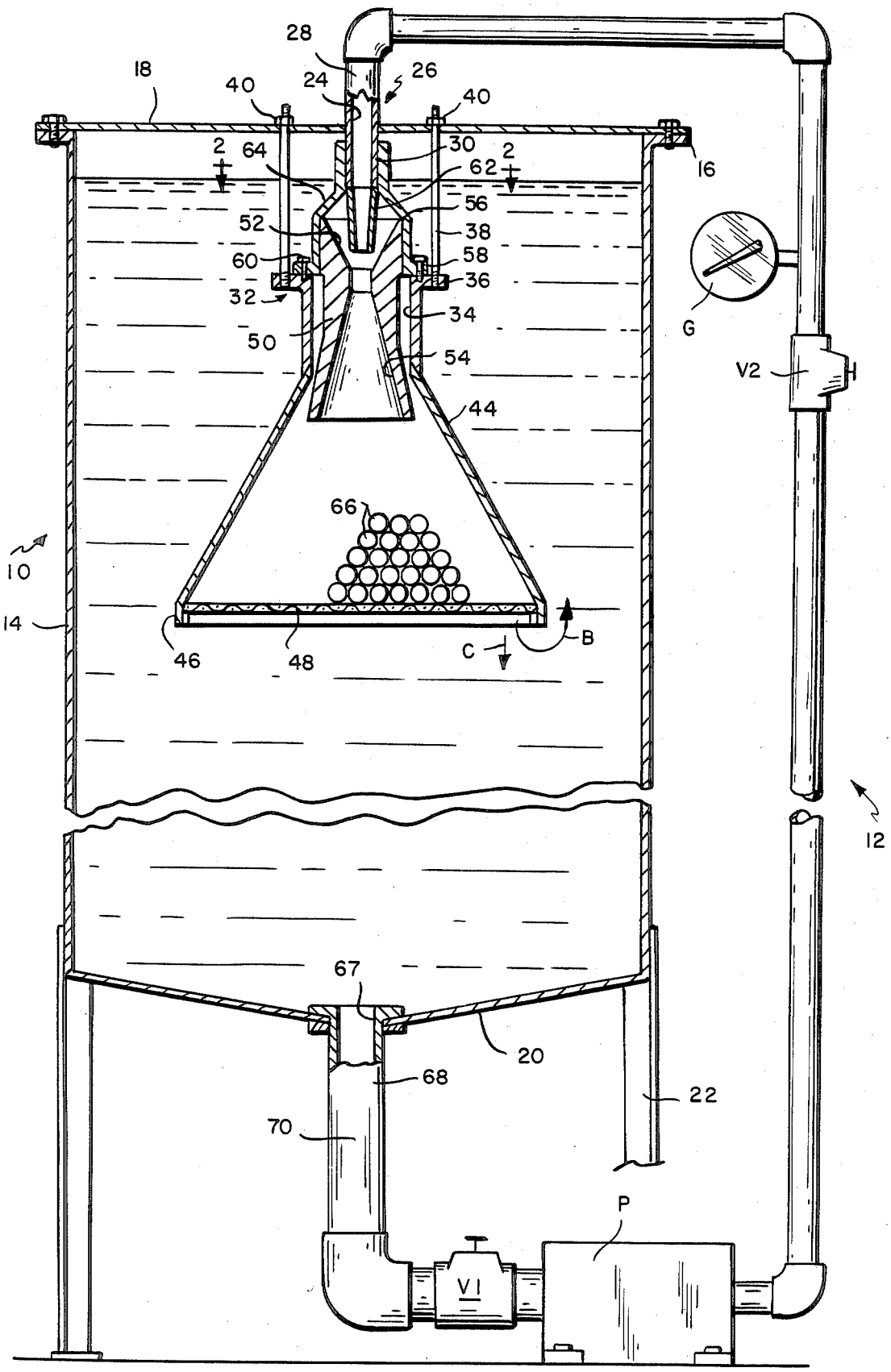
Figure 2:
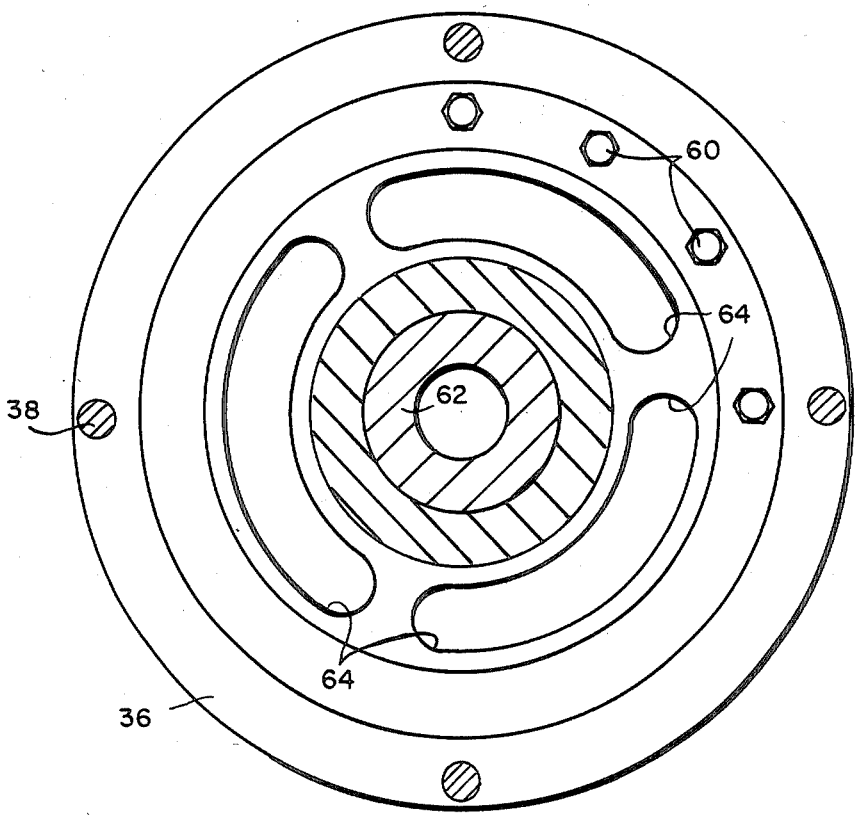

The invention will now be described with reference to the accompanying drawing, wherein:

FIG. 1 depicts the blending module in vertical, diametral section and the plumbing associated therewith partly in section and partly in elevation; and FIG. 2 is a diametrical section taken at line 2—2 of FIG. 1.

Referring to the drawings, the blending module comprises a mixing chamber 10, to the top of which the fluids to be mixed are supplied and from the bottom of which the mixed fluids are withdrawn and plumbing 12 for effecting circulation of the fluids to be mixed from top to bottom and from bottom to top. The module 10 is a cylindrical receptacle 14, at the top of which there is a radial flange 16 to which there is attached a cover plate 18. The bottom of the receptacle is provided with a downwardly-convex bottom wall 20. The receptacle is supported in an upright position by a plurality of legs 22 secured to the lower end of the receptacle.

The cover plate 18 contains a centrally-located opening 24 within which there is supported a conductor pipe 26 with its upper end 28 extending upwardly from the cover plate and its lower end 30 extending into the chamber. A hanger 32 containing a cylindrical opening 34 and provided with an annular flange 36 at its upper end is supported in concentric relation with the vertical axis of the pipe 26 by adjustable rods 38, the lower ends of which are threaded into the flange 36 and the upper ends of which pass through openings 40 in the cover plate and have applied to the upper ends adjusting nuts 42. At the lower end of the hanger, there is a conical housing 44, the upper end of which is welded to the lower end of the hanger 32. The conical housing 44 has at its lower end an annular ring 46 within which there is mounted a grating 48. The hanger also supports at its upper end a Venturi 50 provided with an upper conical open end 52 and a lower conical open end 54. The upper end of the Venturi is threaded into the lower end of a shroud 56 and the upper end of the latter is threaded onto the pipe 26. The shroud 56 has at its lower end a peripheral flange 58 which is secured to the upper end of the hanger by bolts 60. A nozzle 62 secured to the lower end of the pipe 26 extends into the upper open end 52 of the Venturi and the shroud contains openings 64 positioned around the nozzle 62.

A quantity of loosely-associated spherical balls 66 are supported by the grating within the conical housing 44 forming therein a bed which partially fills the conical housing to an extent to be coextensive in area to the cross-sectional area of the housing at a predetermined level therein.

At the bottom of the receptacle 14, there is a centrally-located opening 67 within which there is fixed the upper end of a pipe 68. The upper end 28 of the pipe 26 at the top of the receptacle 14 and the lower end 70 of the pipe 68 at the bottom of the receptacle are interconnected by the plumbing 12 which comprises a valve V1, a screw pump P and a valve V2. In the plumbing above the valve V2, there is a pressure gauge G.

In operation, the fluids to be mixed to effect blending are introduced into the tank at the top by way of the pipe 26 and nozzle 62 and through the Venturi 50 into the upper end of the conical housing 44. The tank is filled with the fluids to be blended to the level indicated at A—A, whereupon the fluids within the tank are circulated by drawing the fluids from the lower end of the tank and returning them by way of the plumbing to the upper end of the tank, the circulation being achieved by operation of the screw pump P. As this circulation takes place, the fluids entering the housing 44 from the nozzle 62 are forced through the bed of loosely-associated, spherical bodies 66 at a pressure which causes weltering of the bodies, the effect of which is to thoroughly mix the fluids. Simultaneously, fluid within the tank at the upper end of the Venturi is drawn by the Venturi in through the openings 64 and combined with the fluid entering through the nozzle 62 so that there is a counterflow of the fluids in the upper part of the tank which further mixes the fluids with each other. The counterflow is illustrated by the arrows B while the transport of the fluid as a whole from top to bottom is indicated by the arrows C. By adjusting the pump action and the valves, the rate and pressure of flow through the Venturi may be varied in accordance with the character of the fluids to be mixed to achieve maximum mixing. Further, by changing the size of the spherical balls 66 and/or their configuragion, for example, by the use of oval bodies or conical bodies or by irregular bodies, mixing action for different kinds of fluids, that is, fluids of different viscosity or solid content can be achieved.

While the operation has been described as one wherein a specific volume of fluids to be mixed was introduced into the tank and repeatedly circulated therein from top to bottom and from bottom to top, it is, of course, within the scope of the invention to fill the tank once and cause it to flow through in one direction only. For example, if the fluids are readily mixable, a single pass should suffice to effect the blending desired.

Desirably, to enable ascertaining the condition of the blending, a site window 72 may be provided in a side of the tank extending from approximately the level 74 to the level 76. There may be one or more of these windows spaced peripherally about the tank.

It should be understood that the present disclosure is for the purpose of illustration only and includes all modifications or improvements which fall within the scope of the appended claims.

I claim:

1. A blender comprising means defining a first chamber for receiving fluids to be blended, said first chamber having upper and lower ends, means for supplying the fluids to be blended to the upper end of said first chamber and for withdrawing the blended fluids from the lower end and means within said first chamber for blending the fluids while in transport from the upper end to the lower end comprising a second chamber within the first chamber adjacent the upper end containing a bed of loosely-associated, buoyant bodies through which the fluids are compelled to flow as they are transported from the upper end to the lower end and a Venturi in the first chamber arranged to deliver fluid supplied to the upper end of the first chamber into the second chamber and simultaneously to induce fluid from the first chamber into the second chamber.

2. A blender according to claim 1 wherein the second chamber is in the form of an inverted cone and the discharge end of the Venturi is positioned at the apex of the cone.

3. A blender according to claim 2 wherein the cone is provided with a grate at its base for retaining the buoyant bodies.

4. A blender according to claim 1 wherein a pump is provided for supplying fluids to be blended to the upper end of the second chamber.

5. A blender according to claim 1 wherein the first means is a pump having an intake side connected to the lower end of the first chamber and a discharge side connected to the upper end of the first chamber.

6. A blender according to claim 5 wherein there is plumbing connecting the lower end of the first chamber to the intake side of the pump and the discharge side to the upper end of the first chamber to continuously withdraw fluids from the lower end of the first chamber and introduce the withdrawn fluids to the upper end of the first chamber.

7. A blender according to claim 1 wherein the fluids are delivered into a second chamber at a pressure to cause weltering of the buoyant bodies as the fluids are forced through the bed.

* * * * *